United States Patent [19]

Helmig et al.

[11] 4,200,016

[45] Apr. 29, 1980

[54] APPARATUS FOR FORMING A HORIZONTAL STACK OF VERTICALLY ORIENTED SHEETS

[75] Inventors: Richard W. Helmig, Owings Mills, Md.; Clinton L. Berwick, East Hampton, Mass.

[73] Assignee: Rotographic Machinery, Owings Mills, Md.

[21] Appl. No.: 915,247

[22] Filed: Jun. 13, 1978

[51] Int. Cl.[2] ..... B65H 29/18; B65H 29/24; B65H 29/66; B65H 31/06

[52] U.S. Cl. ..... 83/88; 198/462; 271/185; 271/197; 271/202; 271/214

[58] Field of Search ..... 271/184, 185, 202, 214, 271/177, 181, 182, 183, 197, 212, 178, 216, 270, 1, 2, 229–231; 198/423, 462; 83/88; 414/103, 109, 106, 107, 108

[56] References Cited

U.S. PATENT DOCUMENTS

| | | | |
|---|---|---|---|
| 2,844,373 | 7/1958 | Van Marle | 271/178 |
| 2,987,314 | 6/1961 | Monaghan | 271/197 |
| 3,076,649 | 2/1963 | Stevenson | 271/185 X |
| 3,653,656 | 4/1972 | Stobb | 271/202 X |
| 3,659,840 | 5/1972 | Ruck | 271/197 X |
| 3,693,966 | 9/1972 | Bloom | 271/1 |
| 3,780,921 | 12/1973 | Harp | 83/88 X |
| 3,861,515 | 1/1975 | Runyan et al. | 271/202 X |

FOREIGN PATENT DOCUMENTS

| | | | |
|---|---|---|---|
| 1144522 | 3/1969 | United Kingdom | 414/108 |

*Primary Examiner*—Bruce H. Stoner, Jr.
*Attorney, Agent, or Firm*—Burns, Doane, Swecker & Mathis

[57] ABSTRACT

There is disclosed a sheet handling apparatus wherein sheets are delivered onto a conveyor belt traveling at a slower speed than the speed at which the sheets are delivered. The leading end of a sheet is sucked against the conveyor belt such that a trailing end of the sheet flips upwardly and allows the leading end of the succeeding sheet to pass therebeneath. These sheets are conveyed in lapped relationship by the conveyor belt. At a discharge end of the conveyor the lapped sheets drop sequentially in vertical orientation onto a carrier. A movable retainer plate contacts the initial sheet of the stack and is horizontally displaced thereby as the stack builds up, to maintain the sheets upright and in tightly abutting relationship. The retainer is mounted at the end of a freely movable, horizontally extensible pair of rods onto which the sheets fall, such that displacement of the retainer produces extension of the rods to accommodate additional sheets.

13 Claims, 14 Drawing Figures

14
32
28
30
S"
L
T
S'
54
60
62
46
38
66
56
53
72
76
52
74
S
78
80
16
70
82
20
104
108
116
118
26
68
98
100
90
58
78
52
62
80
54

S
10
12
14
22
26
28
30
32
34
36
38
40
42
44
46
47
48
170
172
174
176
178
180
182
184
186
188
190

APPARATUS FOR FORMING A HORIZONTAL STACK OF VERTICALLY ORIENTED SHEETS

BACKGROUND AND OBJECTS OF THE INVENTION

The present invention relates to sheet handling mechanisms, especially mechanisms for arranging sheets in overlapped relation, and/or arranging them into a horizontal stack.

Sheet stacking mechanisms have been heretofore proposed in which a series of sheets are overlapped and then arranged in a horizontal stack wherein the individual sheets are vertically oriented. Exemplary of mechanisms and techniques which overlap sheets and/or arrange sheets into a horizontal stack are those disclosed in U.S. Pat. Nos. 3,198,046 issued to DeAngelo on Aug. 3, 1965, 3,672,667 issued to Pahlitzsch on June 27, 1972, 3,932,982 issued to Klapp on Jan. 20, 1976, and 3,942,786 issued to Lauren on Mar. 9, 1976.

Mechanisms for overlapping sheets may involve a first conveyor which advances the sheets horizontally in sequence. The sheets are fed onto a more slowly traveling second conveyor so that the leading edge of a sheet on the first conveyor overtakes the trailing edge of the preceeding sheet on the second conveyor. Means is provided for physically raising such trailing edge relative to the leading edge of the succeeding sheet so that the latter may advance beneath the former. Thereafter, the trailing edge is permitted to descend upon the leading edge whereby the sheets are in lapped relation to facilitate subsequent stacking. The above-mentioned DeAngelo and Phlitzach patents are exemplary of such a mechanism.

In DeAngelo an air nozzle is utilized to produce blasts of air beneath the trailing edge to raise the latter. In Pahlitzsch that function is performed by cams which move relative to a suction conveyor carrying the preceding sheet.

It will be realized that the provision of sheet-raising devices, such as air nozzles or moving cams, renders the handling mechanism more complex and expensive and necessitates that precautions be taken to insure that the sheet-raising device is properly synchronized relative to the speed of the conveyors.

One manner of stacking overlapped sheets heretofore proposed involves the use of a pair of mutually opposite endless conveyors, one being of concave configuration, the other of convex configuration. These conveyors form a nip therebetween to grip and advance prelapped sheets from a horizontal orientation to a vertical orientation, whereupon the sheets are dropped into a conveyor-driven trough. As the sheets build-up in the trough, a horizontal stack is established. The aforementioned Klapp patent is exemplary of such a proposal.

The use of a pair of conveyor belts to transport sheets sandwiched therebetween and a driven trough into which the sheets are deposited, constitutes a complex and somewhat unweildy mechanism. If both belts are not driven at identical speeds, damage to the sheets may occur; hence precautions in that area must be taken. The driven trough makes further energy demands on the system, and its speed must be synchronized relative to the rate of sheet feed or else the sheets will not be stacked tightly.

It is, therefore, an object of the present invention to provide a novel sheet handling apparatus which solves or alleviates problems of the above-noted type.

It is another object of the present invention to provide novel apparatus for overlapping sheets.

It is another object of the present invention to provide novel apparatus for arranging sheets in a horizontal stack.

It is another object of the invention to overlap sheets and/or arrange sheets in a horizontal stack, by means of relatively simplified apparatus that are capable of relatively high-speed operation.

It is a further object of the invention to provide such apparatus which involve minimal concern for speed synchronization of sheet transport components.

It is another object of the invention to overlap sheets by advancing sheets onto a downwardly curved suction conveyor such that the act of adhering to the conveyor causes the trailing edge to be raised sufficiently to receive therebeneath the leading edge of the succeeding sheet.

It is still a further object of the invention to arrange overlapped sheets into a horizontal stack by advancing the sheets on a downwardly curved suction conveyor and dropping the sheets onto a displaceable carrier, the carrier being moved by the build-up of sheets thereon.

THE DRAWING

These and other objects of the invention will become apparent from the following detailed description of a preferred embodiment thereof in connection with the accompanying drawing in which like numerals designate like objects and in which.

BRIEF SUMMARY OF THE PREFERRED EMBODIMENTS OF THE INVENTION

The objects of the present invention are achieved by sheet handling apparatus wherein sheets are delivered onto a conveyor belt traveling at a slower speed than the speed at which the sheets are delivered. The leading end of a sheet is sucked against the conveyor belt such that a trailing end of the sheet flips upwardly and allows the leading end of the succeeding sheet to pass therebeneath. These sheets are conveyed in lapped relationship by the conveyor belt.

At a discharge end of the conveyor the lapped sheets drop sequentially in vertical orientation onto a carrier. A movable retainer plate contacts the initial sheet of the stack and is horizontally displaced thereby as the stack builds up, to maintain the sheets upright and in tightly abutting relationship. The retainer is mounted at the end of a freely movable, horizontally extensible pair of rods onto which the sheets fall, such that displacement of the retainer produces extension of the rods to accommodate additional sheets.

DETAILED DESCRIPTION OF A PREFERRED EMBODIMENT OF THE INVENTION

Figure 1:
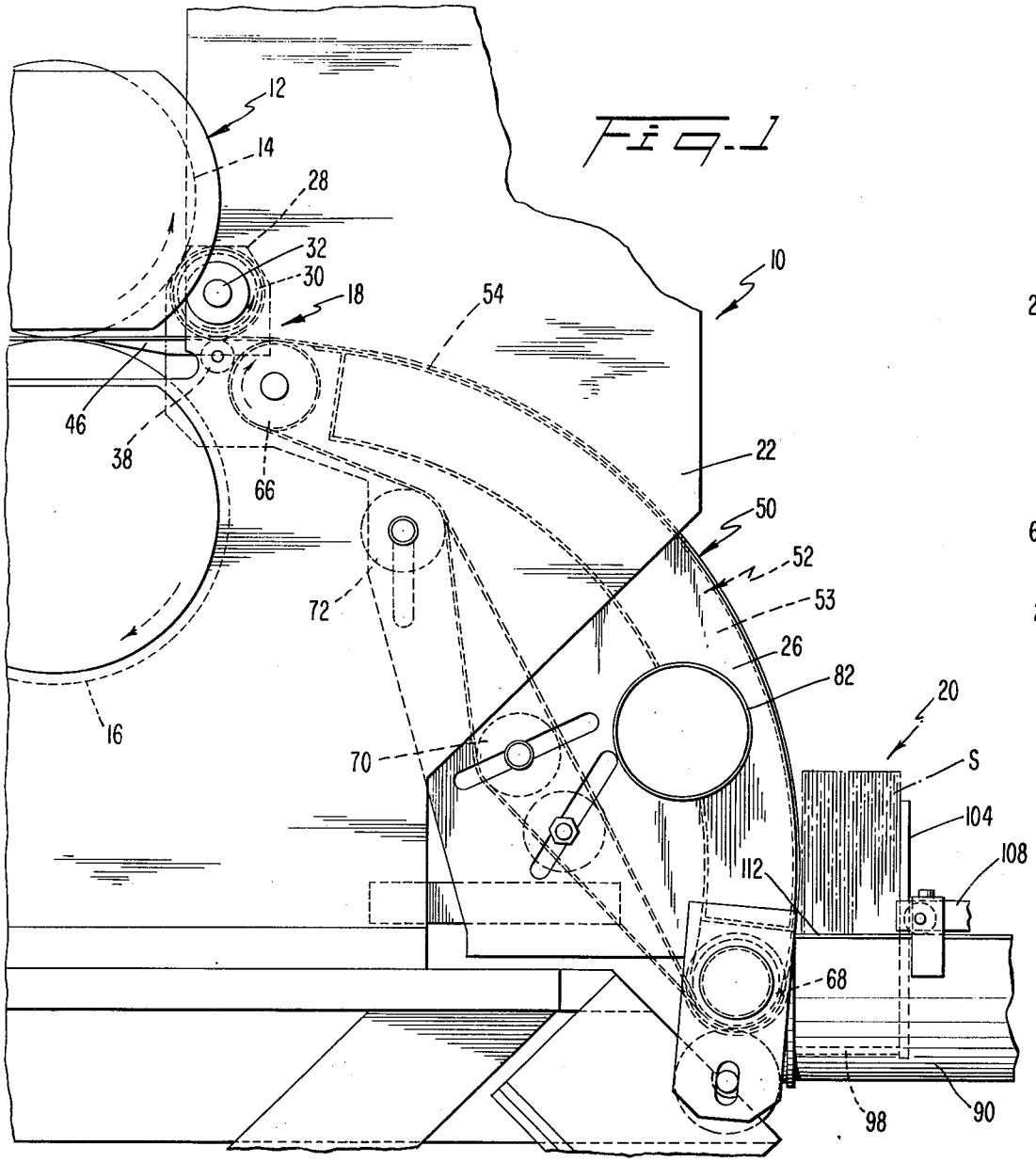
FIG. 1 is a side elevational view of a sheet handling mechanism in accordance with the present invention.

A sheet handling mechanism 10 according to the present invention is positioned at the outlet side of a cutter assembly 12 (FIG. 1). The cutter assembly 12 comprises a rotary cutter wheel or die wheel 14 and an oppositely positioned anvil roller 16. These die and anvil rollers 14, 16 are of a conventional nature and are operable to cut a web into individual sheets S.

For example, into the inlet side of the cutter assembly 12 may be fed a web of paper or other such material which contains printed indicia spaced therealong. The cutter assembly 12 cuts the web into inidicia-bearing sheets. The sheets may comprise, for example, labels to be applied to bottles, or blanks to be formed into paper cups, among other possibilities. The sheets described in the following description are of circular configuration, but it will be appreciated that sheets of any shape can be effectively handled.

It will also be appreciated that the present invention need not be associated with a cutting mechanism, but may simply be positioned to receive sheets fed thereto, as will become apparent from the following discussion.

The sheet handling mechanism 10 includes a lapping portion 18 which arranges the sheets in mutually lapped relationship, and a stacking portion 20 which arranges the lapped sheets into a horizontal stack in which the individual sheets are vertically oriented.

Figure 2:
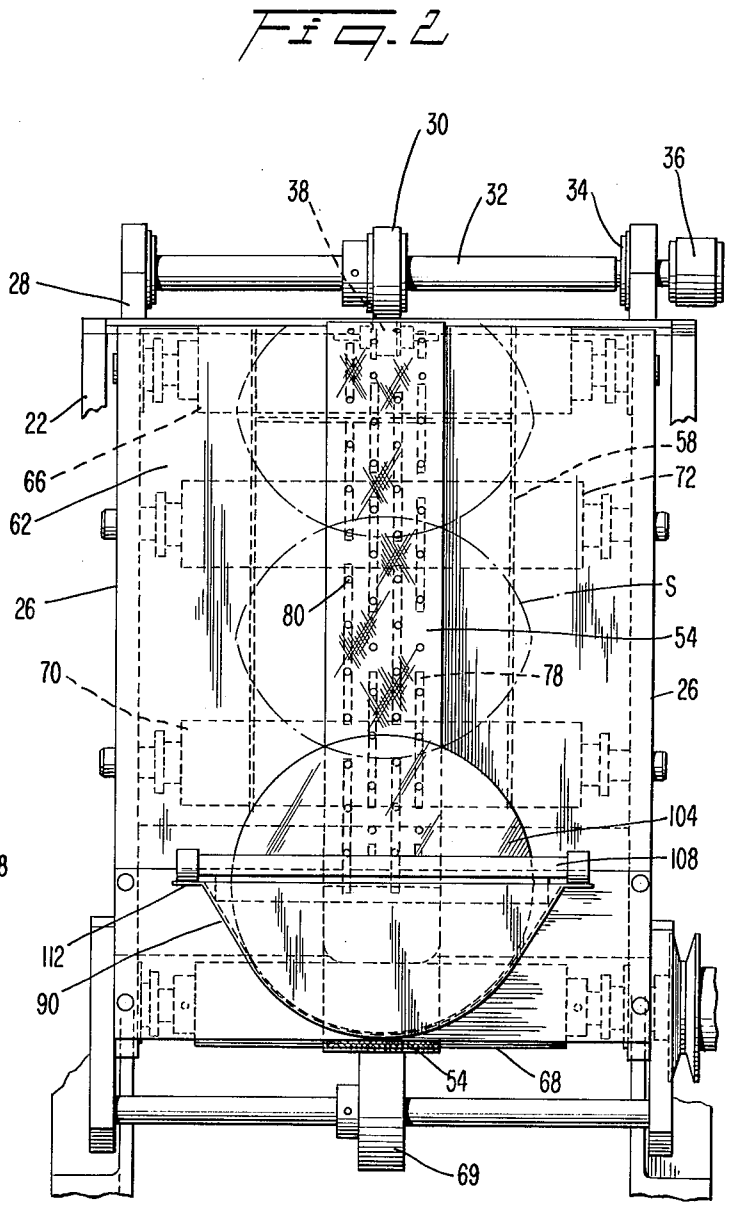
FIG. 2 is a front elevational view of the mechanism of FIG. 1, depicting circular sheets being handled thereby.
Figures 9, 10, 11, 12:
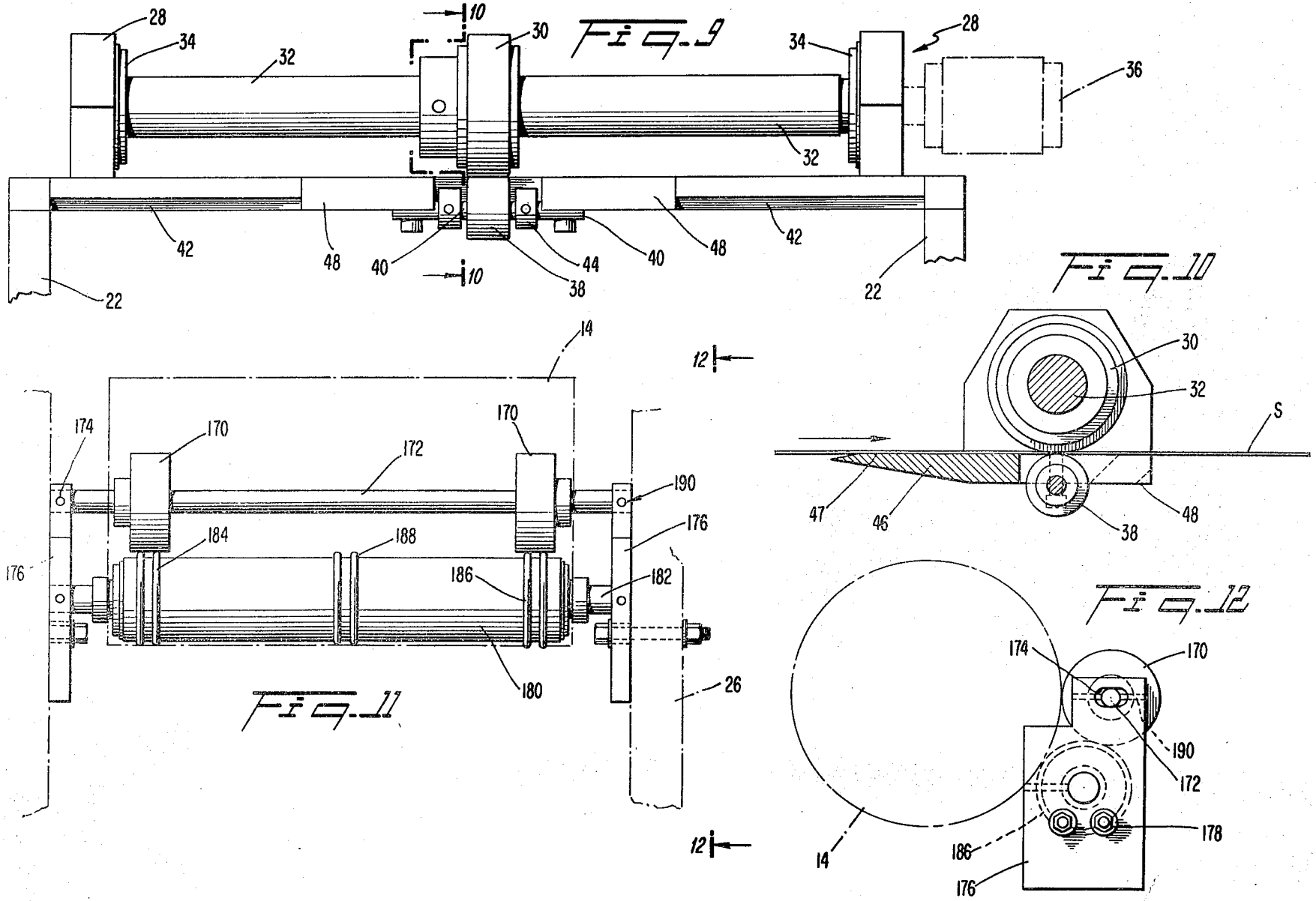
FIG. 9 is a front, fragmentary view of a sheet accelerating mechanism according to the present invention, as viewed from the discharge end thereof.
FIG. 10 is a cross-sectional view taken along line 10—10 in FIG. 9.
FIG. 11 is a view similar to FIG. 9 of an alternative form of sheet accelerating mechanism.
FIG. 12 is a side view of the mechanism depicted in FIG. 11.
Figure 13:
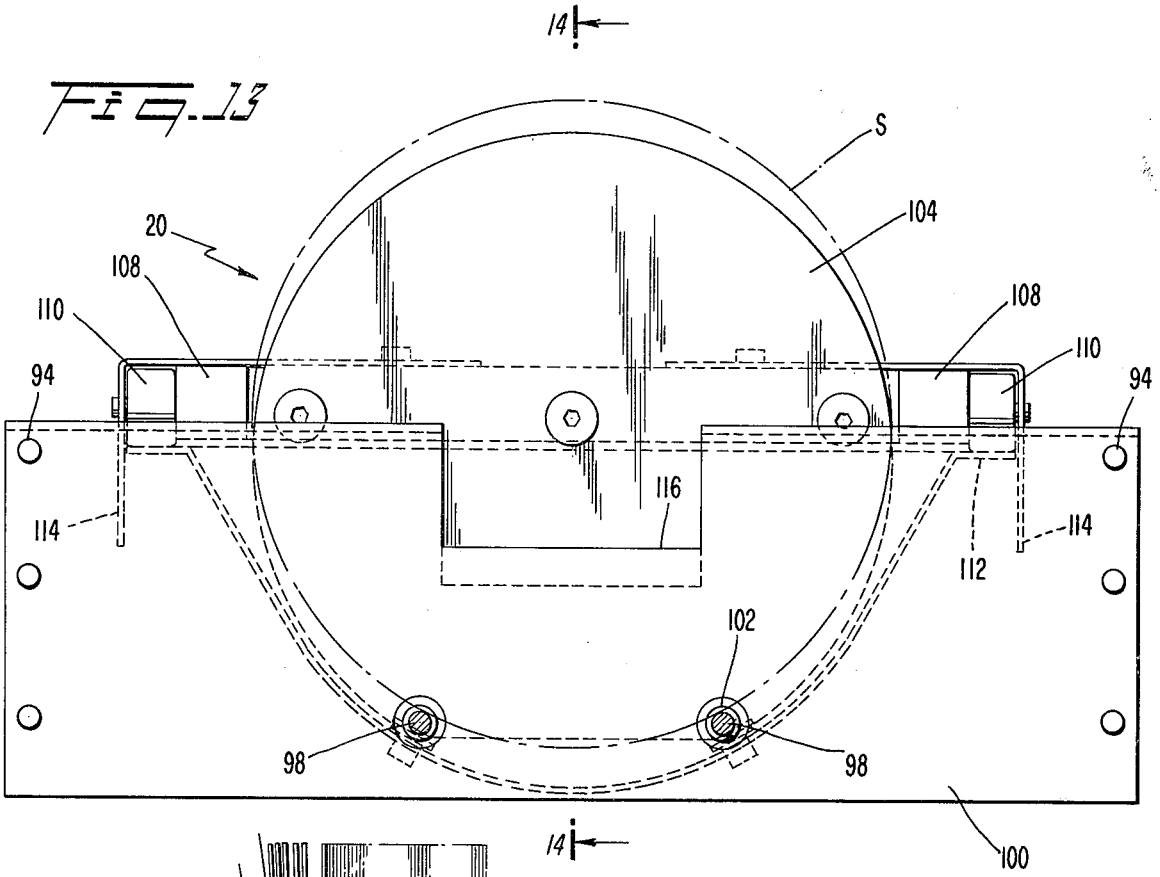
FIG. 13 is a front elevational view of a stacking station according to the present invention (i.e., viewing from left to right in FIG. 14)

The handling mechanism 10 includes a framework 22 including laterally spaced, upstanding side frames, each including a lower portion 26 and an offset upper portion 28. Mounted for rotation in the upper side frame portion 28 is a sheet acceleration roll 30 (FIGS. 2 and 9). The roll 30 is mounted on a horizontal shaft 32 which is rotatably carried at its ends in bearings 34 mounted in the upper side frame portion 28. The shaft 32 is driven by a positive drive from the shaft of the die wheel by means of a gear box schematically depicted at 36 in FIG. 9. The gearing is designed to rotate the acceleration roll 30 at a slightly faster speed than the die wheel, as desired.

Rotatably mounted beneath the acceleration roll 30 is a back-up or pressure roll 38. This pressure roll 38 is rotatably mounted on a stub shaft 40 that is mounted on a member 46 to be discussed below. A pair of retaining collars 44 are positioned on the stub shaft 40 on opposite sides of the pressure roll 38.

The acceleration and pressure rolls 30, 38 are formed of highly resilient material such as rubber or soft plastic, for example, and define an acceleration nip which receives sheets from the cutter assembly 12. As noted above, the acceleration roll 30 is driven at such speed that the sheets received are accelerated to a greater speed.

Upstream of the acceleration roll 30 is positioned a guide plate 46 (FIG. 10). The plate 46 includes a surface 47 which slidingly supports sheets being delivered and which is aligned with the acceleration nip of the acceleration and pressure rolls 30, 38. The guide plate 46 includes a pair of legs 48 which straddle the acceleration roll 30. In this fashion, the surface 47 includes extensions which continue to guide the sheets on opposite sides of the acceleration nip. The support plate 46 is mounted on a cross-bar 42 and directly carries the stub shaft 40 described earlier.

During operation of the mechanism 10, sheets delivered to the acceleration nip are accelerated to greater speed and are discharged toward a conveying mechanism 50.

Figures 3, 4, 5:
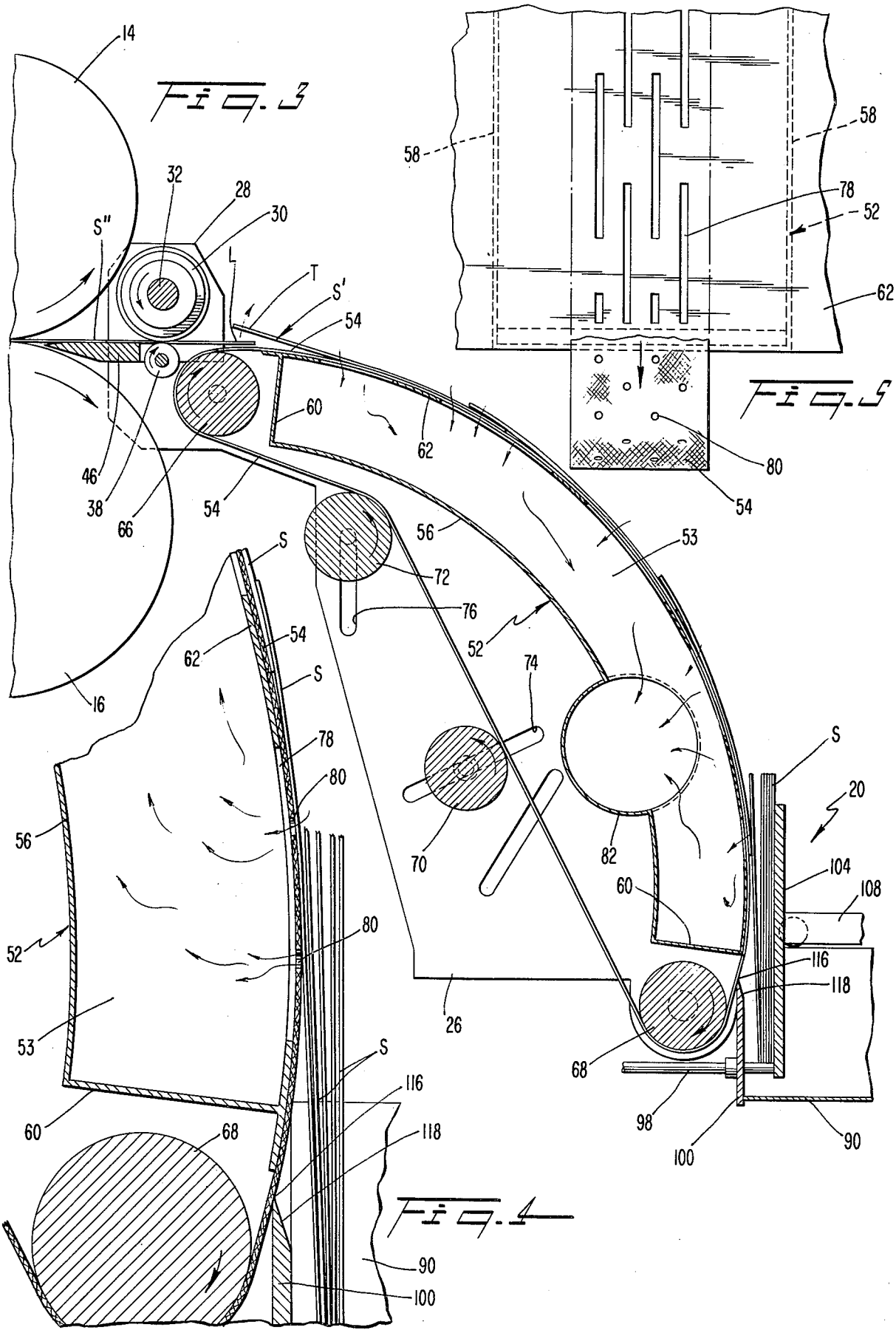
FIG. 3 is a cross-sectional view of the mechanism of FIG. 1, taken along a vertical plane.
FIG. 4 is an enlarged view of a bottom portion of the sheet handling mechanism, depicting sheets as they fall from a conveyor belt and onto a stacking station.
FIG. 5 is a fragmentary view depicting the relationship between conveyor and suction box components of the sheet handling mechanism.

The conveying mechanism 50 comprises a suction box 52 (FIG. 3) around which an endless conveyor belt 54 travels. The suction box 52 comprises an enclosed chamber 53 which is formed by a bottom wall 56, side walls 58 (FIGS. 3 and 5) end walls 60, and a convex top wall 62 (convex as viewed in plan). The upper end portion of the top wall 62 is situated downstream of the acceleration nip, and the lower end portion of the top wall 62 is situated adjacent the stacking station 20.

The endless conveyor belt 54 is wrapped around a guide assembly comprising upper and lower guide drums 66, 68, a pair of tensioning rolls 70, 72, and the top wall 62 of the suction box 52. The upper and lower guide drums 66, 68 are mounted in the side frames 26 for rotation about parallel horizontal axes. A pressure roller 69 may be rotatably mounted beneath the drum 68. The tensioning rolls 70, 72 are adjustably mounted in slots 74, 76 so as to be able to vary the tension on the belt 54, in conventional fashion, and assure that the belt tightly presses against the top wall 62 of the suction box 52.

The lower drum 68 is power driven, as will be discussed, and tapers from its center toward its opposite ends to retain the belt 54 thereon. The upper drum 66 can likewise be tapered.

The top wall 62 includes a plurality of longitudinal slots 78 (FIG. 5) which are aligned in longitudinal rows extending from the upper end to the lower end of the suction box 52. The belt 54 includes a plurality of holes 80 which are aligned in longitudinal rows extending from the upper end to the lower end of the belt 54. During operation, the rows of holes 80 are arranged in alignment with corresponding rows of slots 78, so that the holes intermittently communicate with the suction chamber 53 during travel of the belt 54.

Communicating with the interior chamber 53 of the suction box 52 is a duct 82 (FIG. 3) which communicates with a conventional suction device (not shown). Operation of the suction device produces a vacuum within the chamber 53 which acts exteriorly of the belt 54 through the holes 80. Accordingly, sheets S fed onto the belt 54 will be sucked tightly against the belt 54 via suction forces acting through the holes 80. The upper end of the conveyor belt 54 is positioned slightly below the acceleration nip.

The conveyor 54 is power rotated in such manner that the conveyor speed is less than the tangential speed of the periphery of the acceleration roll 30. That is, the speed of sheets advanced by the acceleration roll 30 is greater than the speed of sheets advanced by the conveyor belt 54.

Accordingly, sheets which are fed by the acceleration roll 30 onto the belt 54, are immediately sucked against the belt 54 and are slowed in velocity.

The top wall 62 of the suction box 52 curves downwardly, and thus the conveyor belt 54 curves downwardly relative to the path along which sheets are discharged from the acceleration nip. Initial ones of the slots 78 are located along this downwardly curved portion of the belt 54.

In practice, a sheet S' (FIG. 3) discharged from the acceleration nip is advanced across and slightly above the upper portion of the conveyor belt 54. When the leading or front end of the sheet reaches the initial suction slots 78 of the suction box 52, it is suddenly sucked downwardly against the belt 54 and is immediately slowed in speed due to the slower speed of the belt 54. Accordingly, the trailing end T of the sheet S', which momentarily continues to travel at the speed and momentum imparted by the acceleration roll, tends to flip upwardly relative to the leading end of sheet S''. Accordingly, the leading end L of a more rapidly oncoming succeeding sheet S'' is able to pass therethrough. Thereafter, when the trailing end T descends atop the leading edge L of the succeeding sheet S'', the sheets S', S'' will be conveyed by the conveyor in lapped relationship. The sheets are fed in timed relationship to assure that all sheets become mutually lapped. A lapped relationship of about three quarters of an inch has been found acceptable in some instances.

Figure 14:
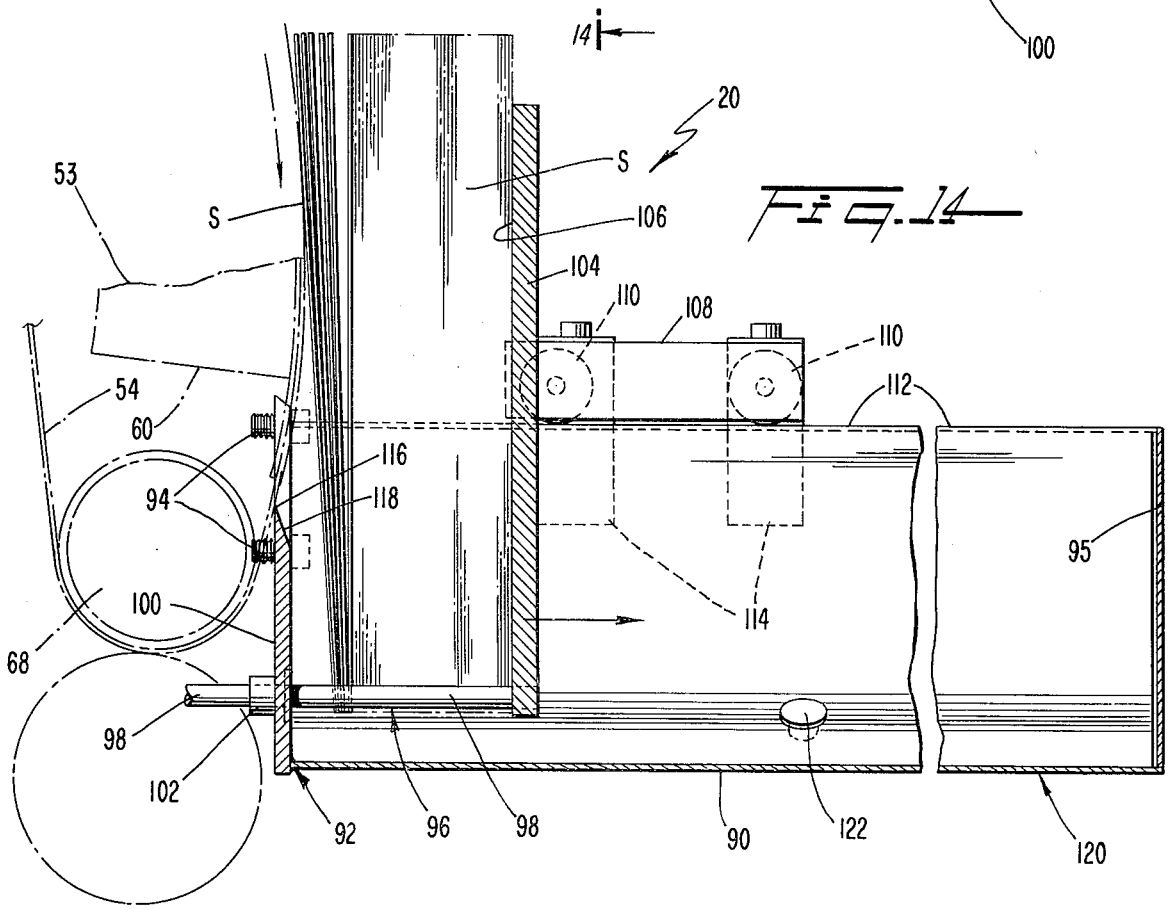
FIG. 14 is a cross-sectional view taken along line 14—14 in FIG. 13.

The stacking station 20 comprises an upwardly open support trough 90 (FIG. 14) which is rigidly fastened at its front end 92 to the rigid framework 22 via bolts 94, and extends outwardly therefrom in unsupported, cantilever fashion. The outer end of the trough is closed by an end wall 95. Mounted on the support trough 90 in a horizontally extensible sheet-supporting mechanism 96. This mechanism 96 comprises a pair of rods 98 which pass through openings in a front wall 100 of the trough 90. Anti-friction bushings 102 formed of nylon or the like surround these openings to slidably carry the rods 98.

Extending upwardly from outer ends of the rods 98 is a sheet retaining plate 104 which includes a reaction surface 106 facing the conveyor belt 54. Mounted to an upper portion of the plate 104 is a wheeled carriage 108, the wheels 110 of which are positioned to travel freely along tracks formed by laterally bent flanges 112 of the trough 90. The wheels 110 are rotatably carried by downwardly bent ears 114 of the carriage.

A central portion of the front wall 100 of the trough is recessed and terminates at its upper end in the form of a sharpened scraping edge 116 which contacts the belt 54 and includes an inclined surface 118.

In practice, sheets S being conveyed by the belt 54 assume a substantially vertical orientation as they travel toward the stacking station 20. When the sheets lose contact with the vacuum of the suction box 52, i.e., as the sheets travel beyond final ones of the slots 78, the leading ends of the sheets tend to fall onto the rods 98. Any sheets which might tend to adhere to the belt 54 are scraped therefrom by the scraping edge 116.

Initially, the rods 98 are in a retracted position such that the plate 104 is situated closely adjacent the belt 54. As sheets collect on the rods 98, the initial sheet contacts the reaction surface 106 of the plate 104 and pushes the plate away from the conveyor. Accordingly, the rods 98 are extended to accommodate additional sheets. In this fashion, the carriage 108 travels along the trough 90 as the horizontal stack of sheets builds-up. The plate 104 holds the sheets in upright positions and maintains them in tight abutment with one another, since the plate 104 is displaced only in response to forces exerted thereagainst by the sheets themselves.

It is assured that the sheets will drop sequentially onto the rods 98 due to the fact that each successive sheet is underlapped in relation to the immediately preceding sheet.

During an initial build-up of sheets, displacement of the plate 104 and carriage 108 by the sheets is accomplished relatively easily. As the stack progresses in size, the weight thereof tends to act downwardly on the trough 90. Since the trough is unsupported at its outermost end 120, it will tend to deflect downwardly by an amount which is slight, but sufficient to enable gravity to aid in the further displacement of the carriage 108 and plate 106. Otherwise, as stacking progressed it could become very difficult for the arriving sheets to push against a long stack sufficiently to advance the plate.

As the rods 98 progress in their extended travel, they ride atop discs 122 which are carried by the trough 90. These discs 122 are formed of an anti-friction material such as nylon to facilitate travel of the rods.

Since the rods are extended during stacking, no friction occurs as would be the case if the rods were immovable. Moreover, the rods are displaced by a build-up of sheets, rather than by a separate drive mechanism so energy requirements are minimized.

Figure 6:
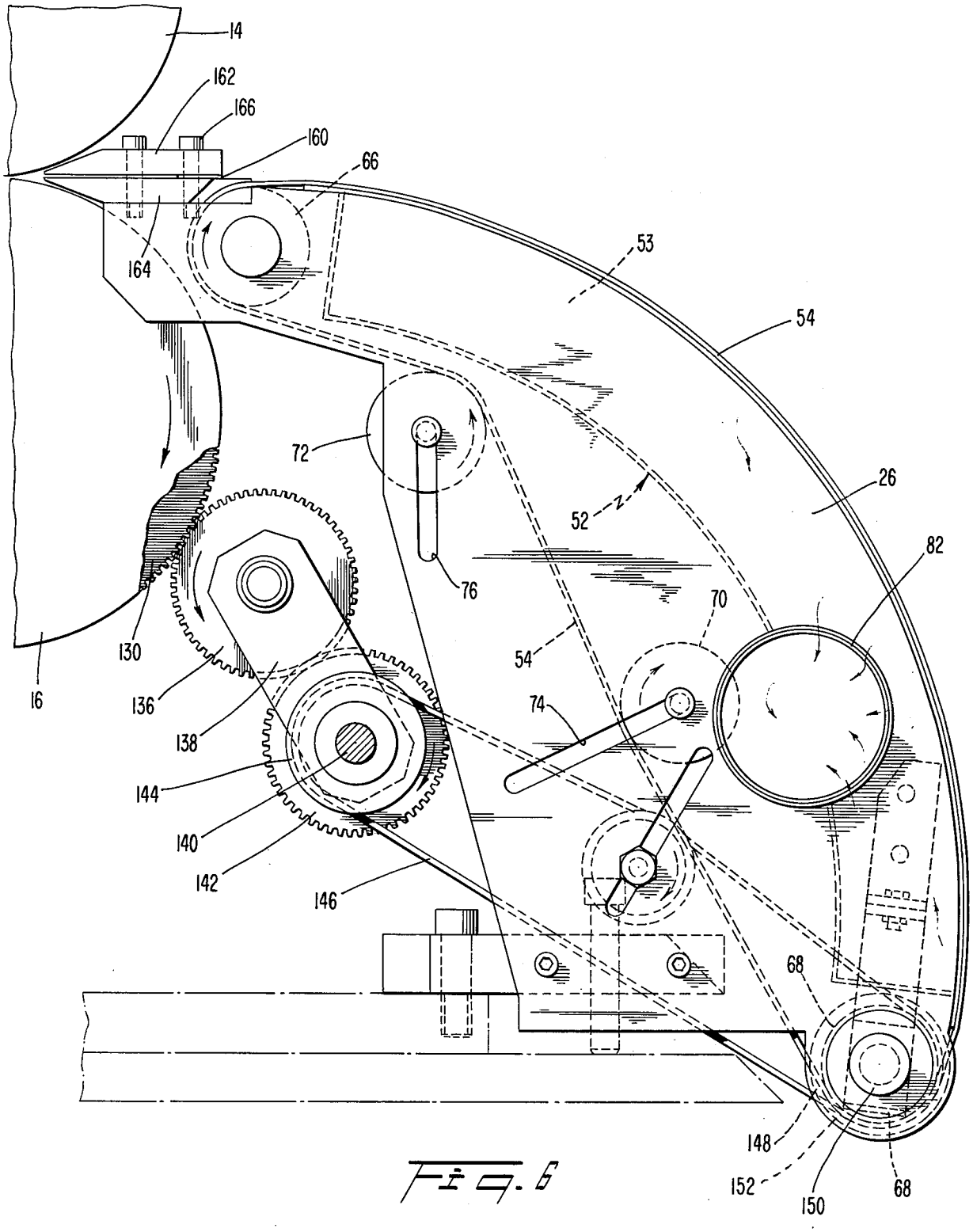
FIG. 6 is a side elevational view of an alternative embodiment of the present invention and depicting a drive mechanism common to both embodiments.
Figure 7:
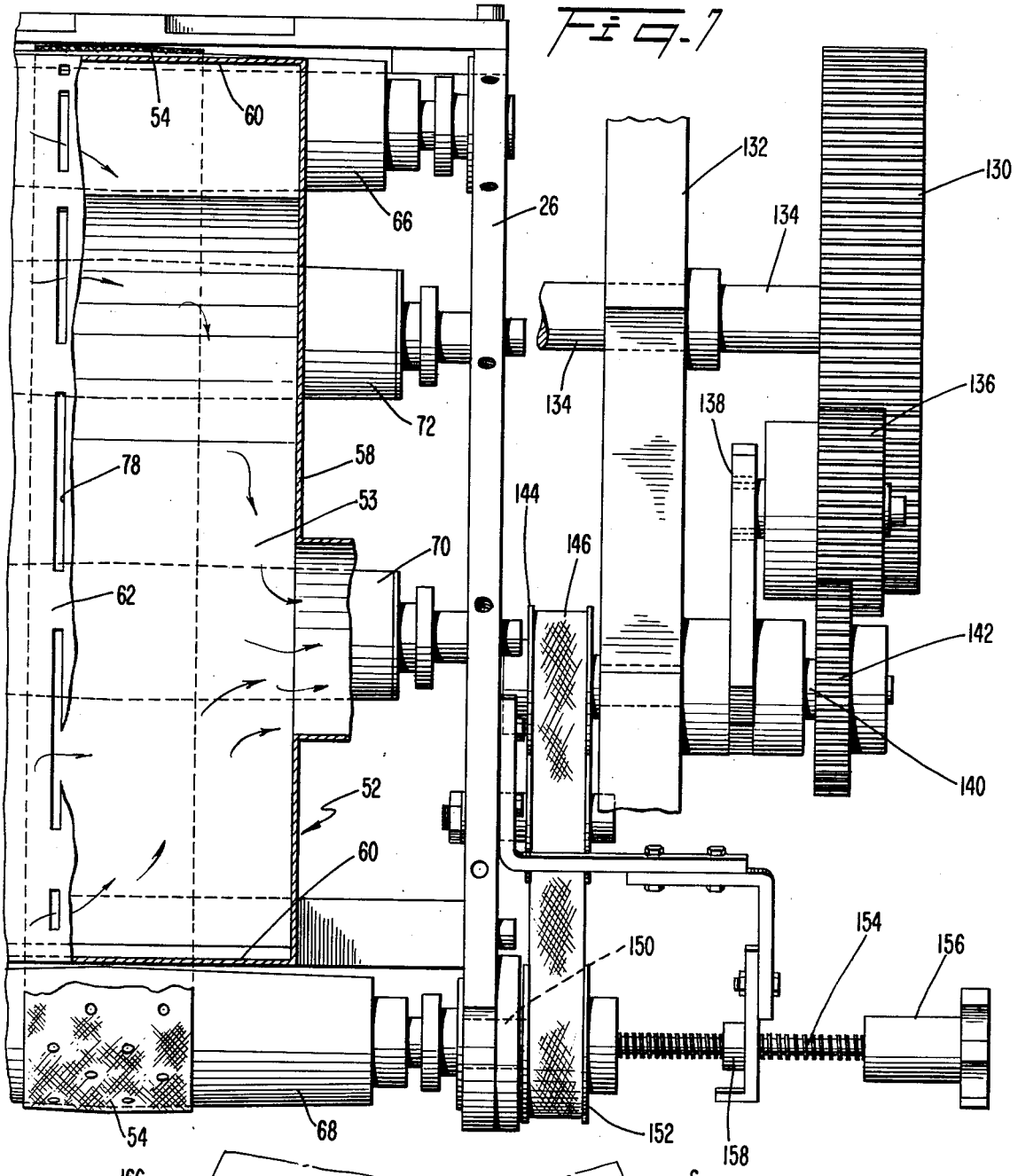
FIG. 7 is a front elevational view of the embodiment depicted in FIG. 6.
Figure 8:
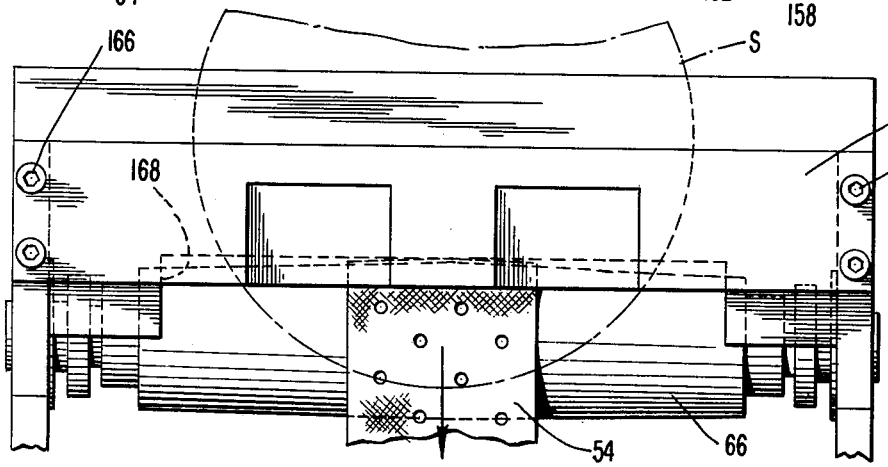
FIG. 8 is a plan view of an upper portion of a conveyor belt of the embodiment depicted in FIG. 6.

The drive mechanism for the sheet handling mechanism is shown in FIGS. 6 and 7. Mounted coaxially with the anvil roller is a first gear 130. This gear 130 extends outwardly of a main housing part 132 of the mechanism on a shaft 134. This gear 130 is in driving relation with a second gear 136 which is mounted on an arm 138, the arm 138 being mounted on a shaft 140 extending from the main housing part 132. Keyed on the shaft 142 is a wheel 144 around which is wrapped a drive belt 146. The drive belt 146 is also wrapped around a variable pitch pulley 148 mounted on a shaft 150 which carries the lower drum 68 of the conveyor belt. In this fashion, rotation of the anvil roller 16 is transmitted to the conveyor belt 54 to drive the latter at a preselected speed relative to the cutting assembly 12.

The pulley 148 comprises separable flange portions 152 at each side. One side of the wheel is attached to a threaded rod 154 on which is mounted a manually rotatable knob 156. The rod passes through a stationary nut 158 so that rotation of the knob 156 changes the pitch of the pulley 148 to vary the belt speed.

In FIGS. 11 and 12 an alternative form of acceleration mechanism is depicted. A pair of resilient drive rolls 170 are rotatably mounted on a shaft 172 which is carried within slotted openings 174. The openings 174 are disposed on plates 176 which are affixed to the side frames 24 by bolts 178. The acceleration roll 180 comprises a cylinder which is rotatably mounted on an axle 182, the ends of the axle being mounted in the plates 176. The acceleration roll 180 carries three pairs of O-rings 184, 186, 188. The outside O-rings 184, 186 are in frictional contact with the drive rolls 170. The central O-rings 188 are in frictional contact with a pressure roll (not shown) which may be similar to the pressure roll 38 discussed earlier. The shaft 172 is adjustably mounted within the slotted openings 174 by means of threaded screws 190 so that the drive rolls 170 may be positioned in contacting relationship with the die roller 14 and the outer O-rings 184, 186. In this fashion, as the die roller 14 is driven, rotary motion is transmitted to the acceleration roll 180 to rotate the latter in appropriate speed ratio with the cutter assembly 12. Slippage therebetween is resisted by the use of O-rings 184, 186 which concentrate the contact forces in small areas.

In FIGS. 6 and 7 an alternative form of sheet delivery mechanism is depicted wherein the acceleration and pressure rolls 30, 38 have been eliminated. Instead, the sheets are fed directly to the conveyor 54 by the cutting assembly 12. As the sheets are discharged from the cutting assembly 12, they are guided through a slot 160 formed between a pair of upper and lower guide blocks 162, 164. These blocks are secured to the side frames 24 by bolts 166. The lower block 164 is recessed at its center 168 to accommodate passage of the upper end of the conveyor belt 54. As the sheets travel through the slot 160, they are maintained in a generally flat or planar condition, suitable for being sucked against the conveyor belt.

IN OPERATION of the present invention, a web is fed to the cutting assembly 12 wherein it is cut into sheets S. The sheets S are grabbed and accelerated by the acceleration roll 30. The leading end of an accelerated sheet S′ (FIG. 3) is sucked onto a conveyor belt 54 and the trailing end T thereof flips upwardly to receive therebeneath the leading end L of a succeeding sheet S″. Subsequently, the trailing end T of the preceding sheet S′ assumes a position atop the leading edge L of the succeeding sheet S″. Hence, the sheets S, S″ are fed on the belt 54 in underlapped relationship.

A continuous stream of underlapped sheets is delivered to the stacking station 20. As the sheets are released from the suction forces, they fall onto the rods 98 in vertical orientation. The sheets fall in successive order due to being underlapped relative to the preceding sheet. As the sheets build-up on the rods 98, they force the carriage 108 away from the belt 54, thereby extending the rods 98 to accommodate additional sheets. The sheets, in effect, stack themselves in tight relationship. Continued build-up of the stack causes a slight downward bending motion of the cantilever-mounted support trough 90 so that gravity facilitates further displacement of the carriage 108 by the sheets.

As a result of the present invention, sheets are fed and stacked in rapid fashion. This is achieved by a simplified mechanism in which no specially operated sheet raising devices are required for producing an underlapped relation of the sheets. The underlapped sheets are fed by a single conveyor belt and, in effect, stack themselves in tight mutual abutment. The stacking is achieved with minimal friction and energy expenditure by the freely extensible rods. Gravity is utilized to facilitate stacking as the size of the stack grows and bends the cantilever-mounted trough.

Although the invention has described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. Apparatus for arranging mutually lapped sheets in a horizontally stacked relationship comprising:

a power driven conveyor belt including a downwardly traveling conveying segment;

suction means creating a vacuum at the surface of said conveying segment for retaining mutually lapped sheets thereagainst;

sheet stacking means disposed at a lower portion of said conveying segment to receive sheets falling in generally vertically oriented relationship from said belt, said sheet stacking means including:

support means comprising a freely movable, horizontally extensible structure onto which said sheets fall, and a movable sheet retaining member comprising an upstanding plate engageable with the initial sheet of a stack and progressively displaced away from said belt by a build-up of sheets on said support means;

said extensible structure comprising a plurality of rods whose outer ends are connected to said retaining plate such that displacement of said retaining plate extends said rods to receive additional sheets;

said stacking means comprises a fixed trough on which said rods are slidably mounted, said trough being secured at an end closest to said conveyor belt and unsecured at its outer end such that said trough deflects in responsive to a build-up of the stack, such that gravity aids in the further extension of said rods and retaining member.

2. Apparatus according to claim 1, wherein said stacking means further comprises a wheeled carriage mounted at an upper end of said plate, the wheels of which are freely supported for travel on said trough.

3. Apparatus according to claim 1, wherein said trough carries a plurality of spaced elements formed of antifriction material and arranged to support said extensible rods.

4. Apparatus according to claim 1, further including a scraper engaging said belt above said supporting means to scrape from said belt sheets tending to stick thereto.

5. Apparatus for arranging sheets into a horizontal stack comprising:

feeding means for continuously feeding sheets in a generally horizontal direction of feed;

an endless conveyor belt including a downwardly inclined sheet transport segment arranged to receive sheets at an upper portion thereof from said feeding means and discharge sheets from a lower portion thereof;

drive means for driving said conveyor belt at a speed slower than the speed at which sheets are fed from said feeding means so that a leading edge of a succeeding sheet overtakes a trailing edge of an immediately preceding sheet carried by said conveyor belt;

suction means for producing a vacuum at the surface of said inclined transport segment of said conveyor belt for drawing a leading portion of the preceding sheet suddenly thereagainst such that the trailing edge of said preceding sheet flips upwardly to permit the leading edge of the succeeding sheet to underlap such trailing edge; and sheet stacking means disposed adjacent said lower portion of said inclined belt segment, said sheet stacking means comprising sheet supporting means for receiving lapped sheets falling from said belt in substantially vertical orientation such that a horizontal stack of sheets forms on said supporting means;

said sheet supporting means including retaining means engageable with an initial sheet of the stack to support the latter and to be displaced thereby as the stack builds-up.

6. Apparatus according to claim 5, wherein said feeding means comprises a pair of oppositely positioned rollers defining a nip therebetween.

7. Apparatus according to claim 5, wherein said feeding means comprises a pair of first oppositely positioned rollers, one of said first rollers comprising a cutter roller for forming sheets from a web delivered thereto; and a pair of second oppositely positioned rollers disposed downstream of said first rollers for receiving sheets from said first rollers and accelerating the speed of such sheets.

8. Apparatus according to claim 5 wherein said suction means comprises a suction box including an inner suction chamber and an upper wall along which said belt travels; said upper wall including a plurality of longitudinally extending rows of slots communicating with said suction chamber; said belt including longitudinally extending rows of apertures aligned with respective rows of slots to transmit suction from said chamber to the surface of said belt.

9. Apparatus according to claim 5, wherein said sheet supporting means comprises a plurality of rods, said retaining means comprises an upstanding plate secured at outer ends of said rods.

10. Apparatus according to claim 9, wherein said stacking means comprises a fixed support trough on which said rods are slidably mounted, said trough being secured at an end closest to said conveyor belt and unsecured at its outer end so that said trough deflects in response to a build-up of the stack, such that gravity aids in the further extension of said rods and retaining means.

11. Apparatus according to claim 10 wherein said stacking means further comprises a wheeled carriage mounted at an upper end of said plate, the wheels of which are freely supported for movement on said trough.

12. Apparatus according to claim 10, wherein said trough carries a plurality of spaced elements formed of antifriction material and arranged to support said extensible rods.

13. Apparatus according to claim 5, further including a scraper engaging said belt above said supporting means to scrape from said belt sheets tending to stick thereto.

* * * * *